US010966536B1

(12) United States Patent
Fitzpatrick

(10) Patent No.: US 10,966,536 B1
(45) Date of Patent: Apr. 6, 2021

(54) DEVICES, KITS, AND METHODS FOR MOUNTING A MULTIFUNCTIONAL CLIP

(71) Applicant: Candy Fitzpatrick, Cooper Landing, AK (US)

(72) Inventor: Candy Fitzpatrick, Cooper Landing, AK (US)

(73) Assignee: NORELIA LLC, Cooper Landing, AK (US)

( * ) Notice: Subject to any disclaimer, the term of this patent is extended or adjusted under 35 U.S.C. 154(b) by 230 days.

(21) Appl. No.: 16/037,349

(22) Filed: Jul. 17, 2018

(51) Int. Cl.
*A47C 16/02* (2006.01)

(52) U.S. Cl.
CPC ..... *A47C 16/02* (2013.01)

(58) Field of Classification Search
CPC ..... A47C 16/02
USPC ..... 297/423.41
See application file for complete search history.

(56) References Cited

U.S. PATENT DOCUMENTS 5,078,056 A * 1/1992 McCauley ..... A47B 3/00 108/115 X
7,066,547 B1 * 6/2006 Russell ..... A47C 16/025 108/115
8,267,477 B1 * 9/2012 Appiah Finn ..... A47C 16/025 297/423.41

* cited by examiner

*Primary Examiner* — Anthony D Barfield
(74) *Attorney, Agent, or Firm* — Michael J. Tavella

(57) ABSTRACT

A footrest that has a central member that has slots formed in it to receive tabs. Attached to the sides of this member are two members that are hinged to the central member. These members have tabs that fit into the slots on the central member. In this way, the footrest can be folded relatively flat in a small square or rectangular form and then be unpacked and unfolded for use. Once the tabs are secure, the footrest is ready for use. In addition, the footrest has open ends that allow a user to carry the footrest. A handle can also be provided to assist in opening the device. Finally, snap clips (with or without magnets) can be used to secure the tab faces in place for storage.

12 Claims, 19 Drawing Sheets

DEVICES, KITS, AND METHODS FOR MOUNTING A MULTIFUNCTIONAL CLIP

CROSS REFERENCE TO RELATED APPLICATIONS

Not Applicable

STATEMENT REGARDING FEDERALLY SPONSORED RESEARCH AND DEVELOPMENT

Not Applicable

BACKGROUND OF THE INVENTION

1. Field of the Invention

This invention relates to footrests and particularly to folding footrests.

2. Description of the Prior Art

People who fly frequently, especially over long distances, can experience discomfort during the trip. People who are of shorter stature suffer from not being able to place their feet fully on the floor of the aircraft. Also, sitting on chairs at home, at the office, or in other locations causes problems for many people. To that end, I developed a folding footrest that is the subject of U.S. Pat. No. D693,135. While this footrest is an improvement to having dangling legs and feet, it is bulky and heavy.

BRIEF DESCRIPTION OF THE INVENTION

The instant invention is an improvement on the aforementioned footrest. It is lighter in weight and far less bulky. It assembles quickly and can be adjusted to provide several different height levels. The design has two alternative embodiments. It consists of a central member that has slots formed in it to receive tabs. Attached to one side of this member is a lower bottom member that is hinged to the central member. This member has a tab face that extends upward and is secured from below in the lower portion of the central member. Note that the tab face is hinged to the bottom member so that it can fold up against the bottom member for storage. The tab face has one or more tabs that fit into the slots on the central member. Changing which slot(s) are selected, adjusts the height of the footrest. Similarly, a top member is hinged to the other side of the central member. Like the bottom member, the top member also has a tab face but which extends downward, and is secured from above in the upper portion of the central member. Note that the upper tab face is hinged to the top member so that it can fold up against the top member for storage. The tab face has one or more tabs that fit into the slots on the central member.

In this way, the footrest can be folded relatively flat into a small square or rectangular form and then be unpacked and unfolded for use. Once the tabs are secure, the footrest is ready for use. In addition, the footrest has open ends that allow a user to carry the footrest. A handle can also be provided to assist in opening the device. Finally, snap clips (with or without magnets) can be used to secure the tab faces in place for storage.

DETAILED DESCRIPTION OF THE INVENTION

Figure 1:
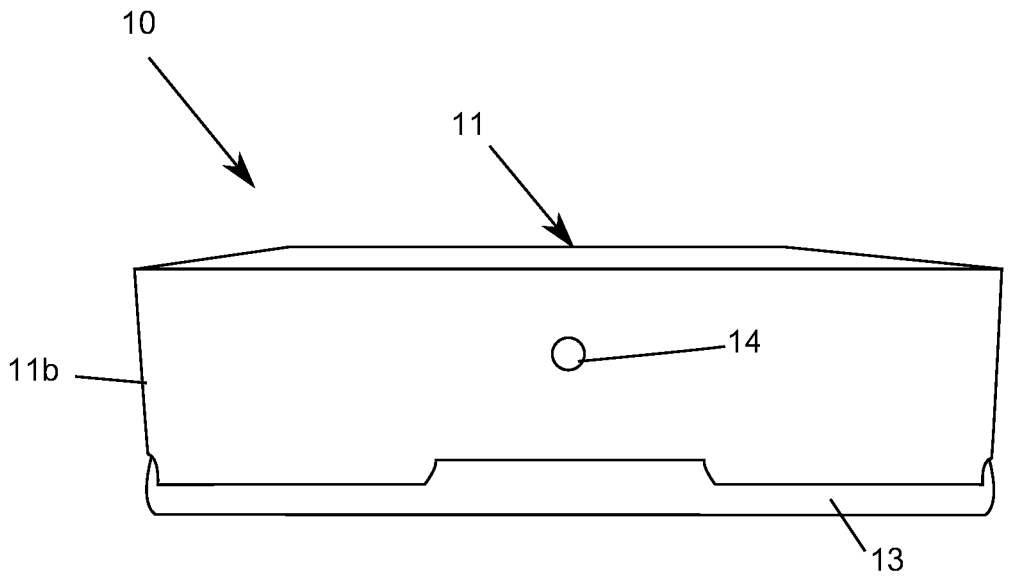
FIG. 1 is a front view of a first embodiment of my footrest.

Referring now to the drawings, and particularly FIGS. 1-6, my footrest 10 is shown. In this view, the invention 10 is a first embodiment of a folding footrest shown in in the assembled position. As shown, the footrest 10 has a top section 11, a bottom section 12 and a central member 13. The top section 11 consists of a top 11*a* and a front piece 11*b*. Similarly, the bottom section 12 consists of a bottom 12*a* and a back piece 12*b*. The central member 13 is a connecting piece that has a number of slots 13*a* formed therein (see, FIG. 13). These slots receive tab members 11*c* on the front piece 11*b* and 12*c* on the back piece 12*b* (see, FIG. 14). In the preferred embodiment two tabs are used. Of course the number of tabs can be changed as desired.

Figure 2:
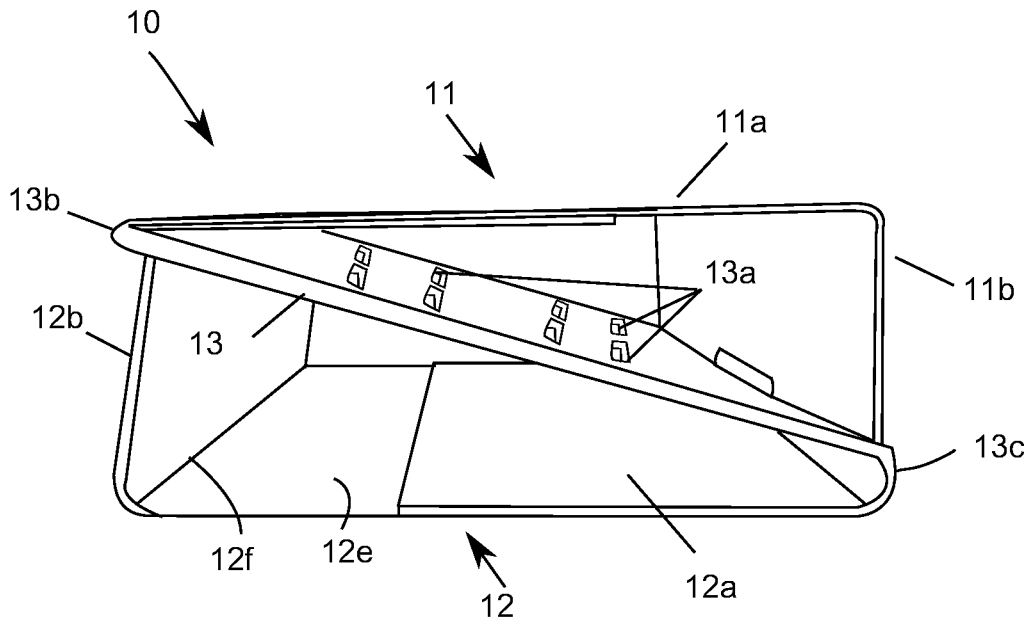
FIG. 2 is a left side view of a first embodiment of my footrest.
Figure 3:
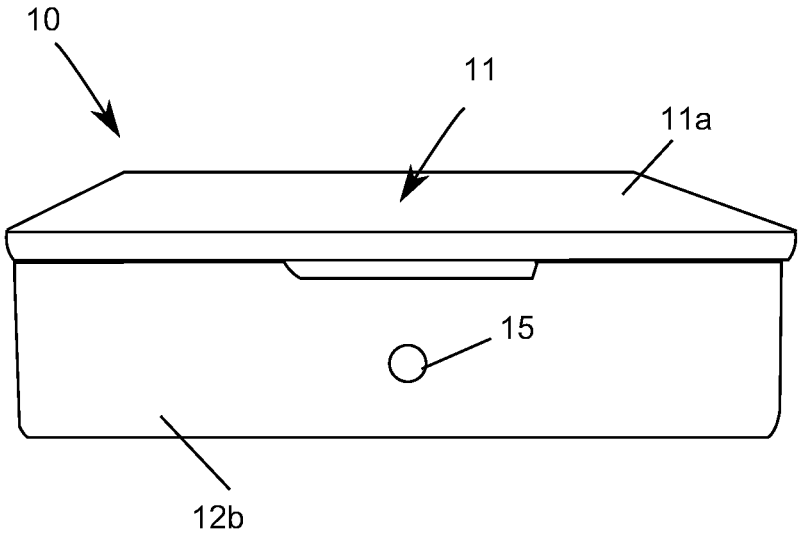
FIG. 3 is a back view of a first embodiment of my footrest
Figure 4:
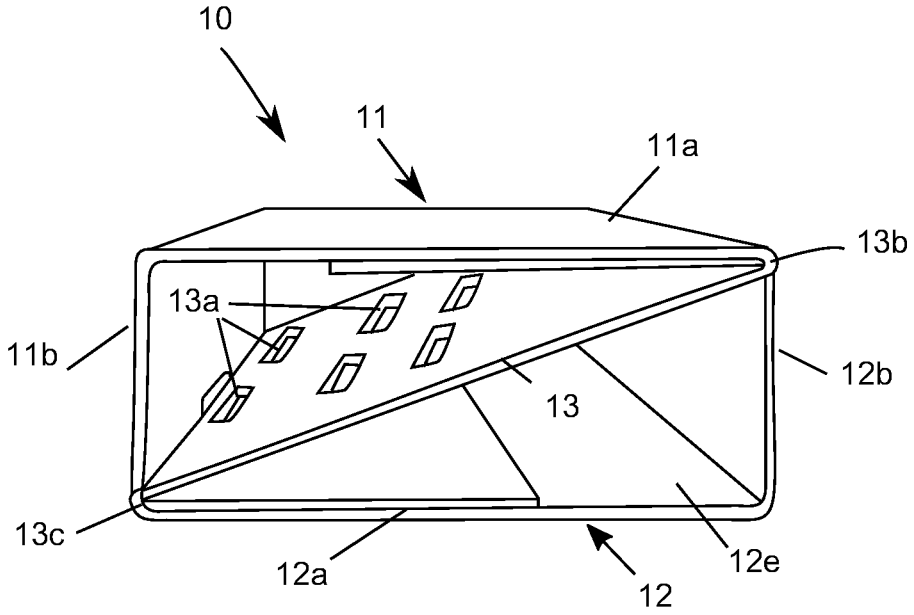
FIG. 4 is a right side view of a first embodiment of my footrest
Figure 5:
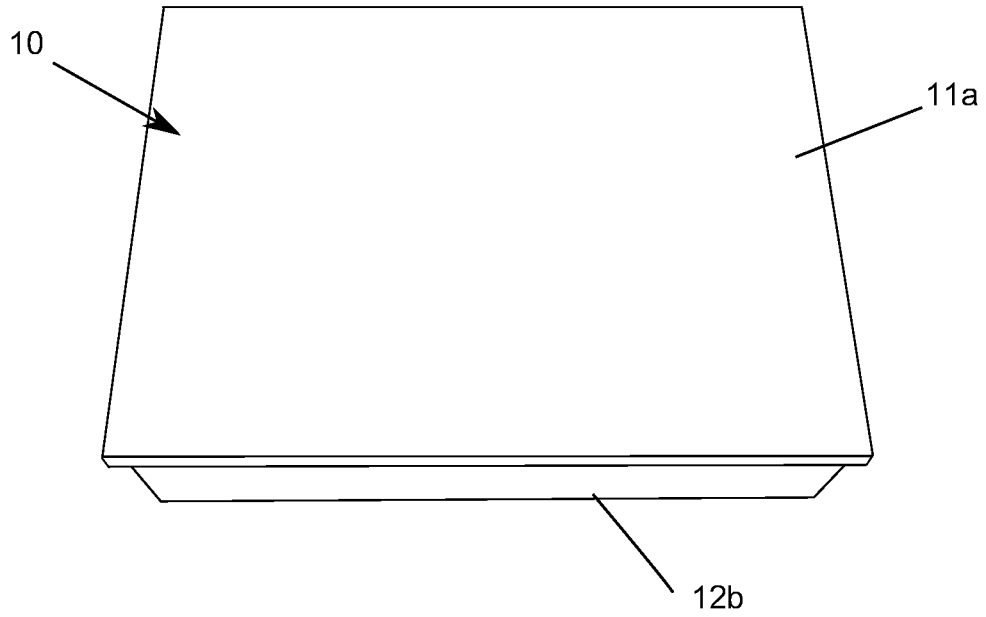
FIG. 5 is a top rear perspective view of a first embodiment of my footrest
Figure 6:
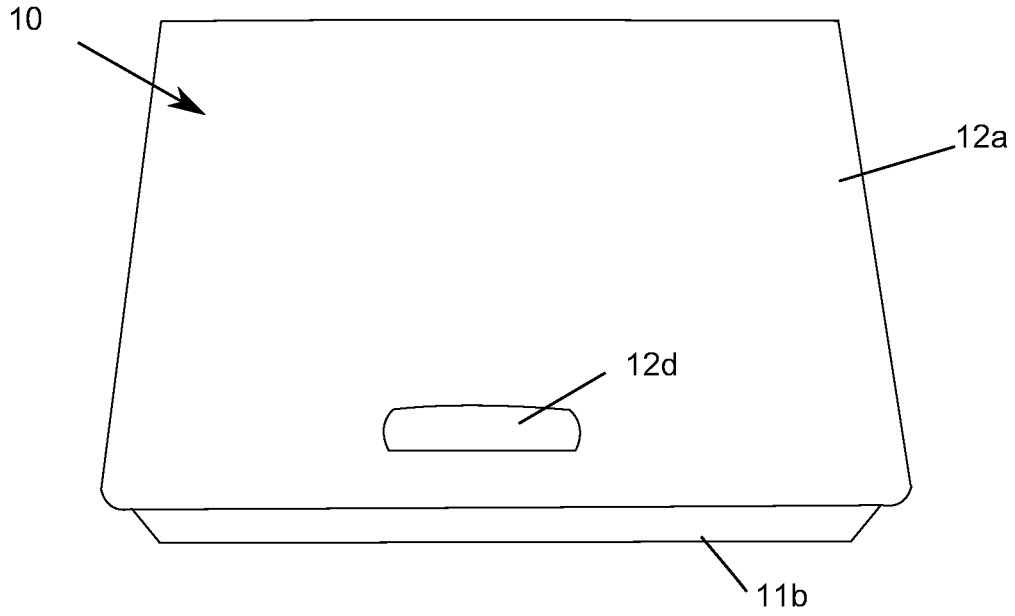
FIG. 6 is a bottom front perspective view of a first embodiment of my footrest.
Figure 7:
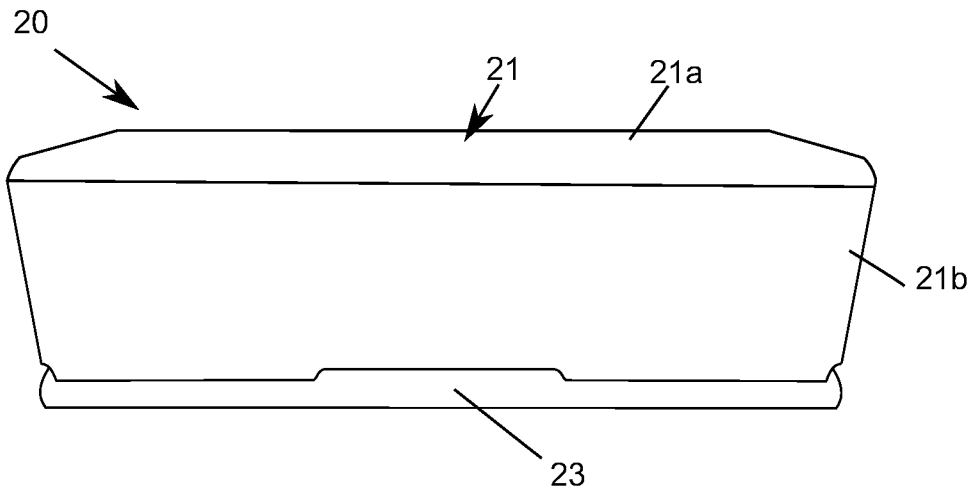
FIG. 7 is a front view of a second embodiment of my footrest.
Figure 8:
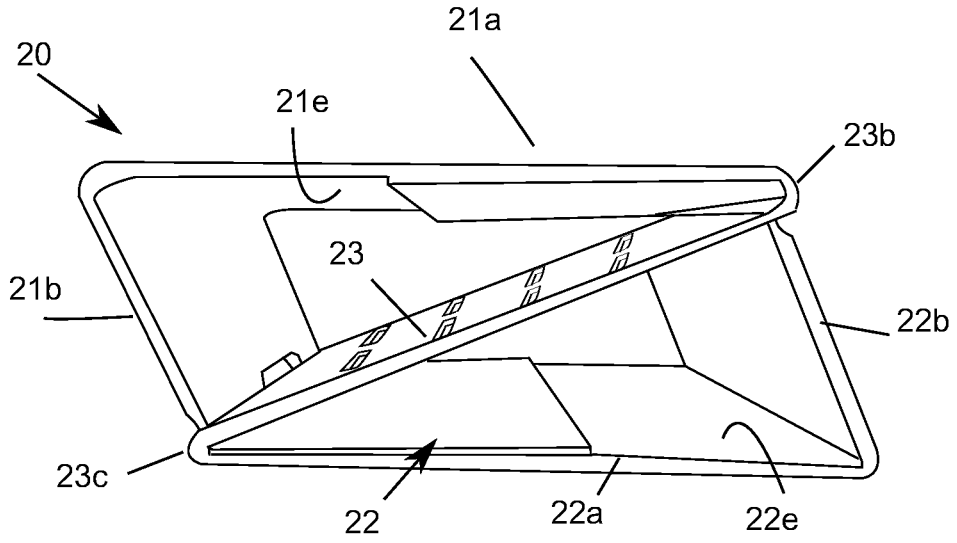
FIG. 8 is a right side view of a second embodiment of my new footrest.
Figure 13:
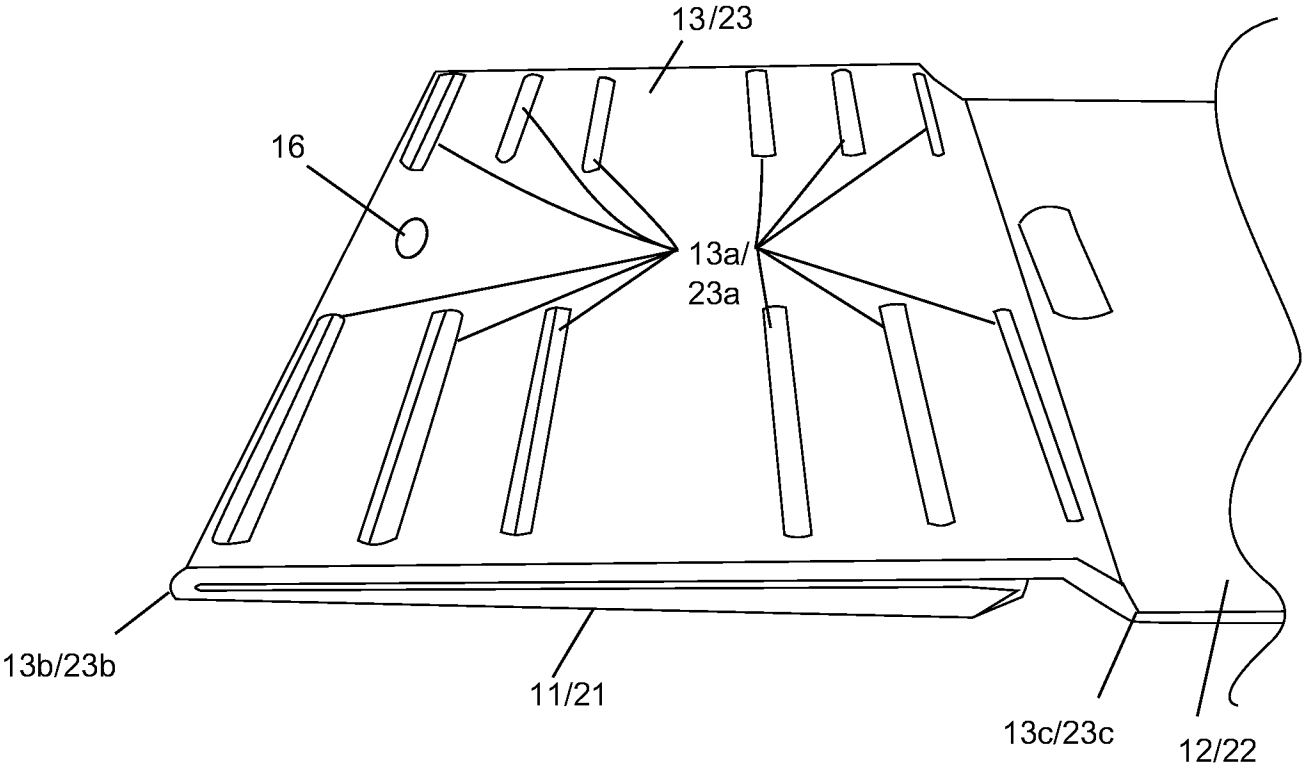
FIG. 13 is a perspective view of the central member of my new footrest.

As shown, the top section is hingably attached to one end 13*b* of the central member 13 and the bottom section is hingably attached to the other end 13*c* of the center portion (as shown e. g., in FIGS. 2, 4 and 13). Note that the top and bottom sections are reversed attached to the central member such that the top section is pulled upwardly and the bottom section is pulled downwardly to open the footrest FIG. 5 is a top view of a first embodiment of my footrest showing the top 11*a*. FIG. 6 is a bottom view of a first embodiment of my footrest showing the bottom 12*a*. Note the handle 12*d* in the bottom is an option.

FIGS. 7-12 are views of a second embodiment 20 of my footrest. As before, this embodiment has a top section 21, a bottom section 22 and a central member 23. The top section 21 consists of a top 21*a* and a front piece 21*b*. Similarly, the bottom section 22 consists of a bottom 22*a* and a back piece 22*b*. The central member 23 is a connecting piece that has a number of slots 23*a* formed therein (see, FIG. 13). These slots The present disclosure should not be construed in any limited sense other than that limited by the scope of the claims having regard to the teachings herein and the prior art being apparent with the preferred form of the invention disclosed herein and which reveals details of structure of a preferred form necessary for a better understanding of the invention and may be subject to change by skilled persons within the scope of the invention without departing from the concept thereof. Receive tab members 21*c* on the front piece 21*b* and 22*c* on the back piece 22*b*. Note that FIGS. 13-17 apply to both embodiments.

The only real difference between these embodiments is the final shape of the assembled footrest. As shown in FIG. 2, the first embodiment is generally box-like, with substantially vertical front and back pieces. The second embodiment has angled front and back pieces as shown, e. g., FIG. 8.

Figure 9:
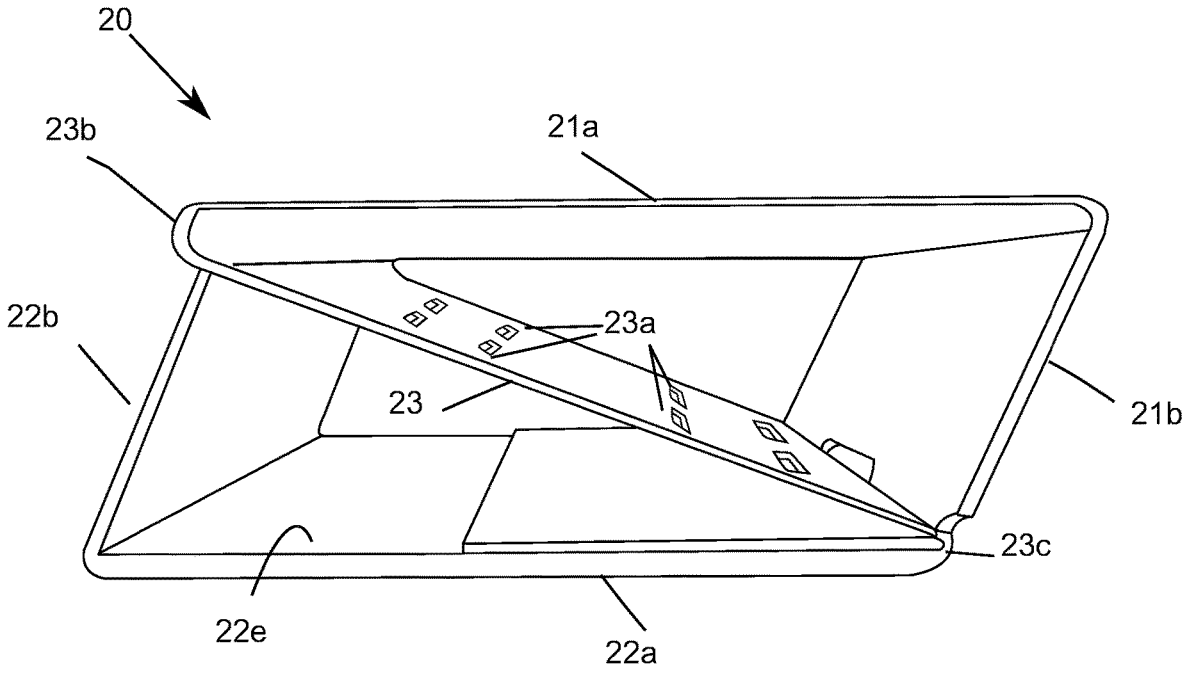
FIG. 9 is a left side view of a second embodiment of my footrest
Figure 10:
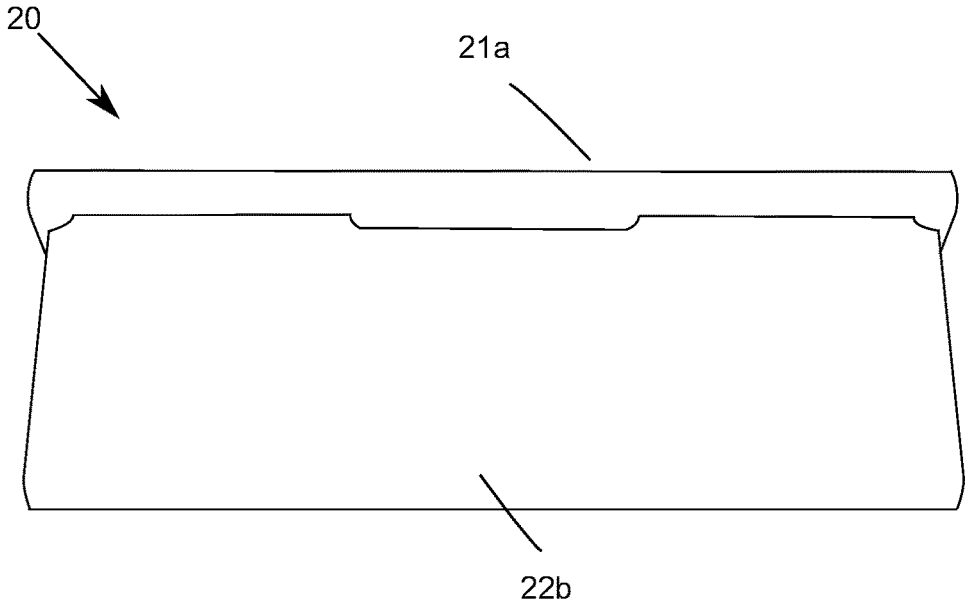
FIG. 10 is a back view of a second embodiment of my footrest
Figure 11:
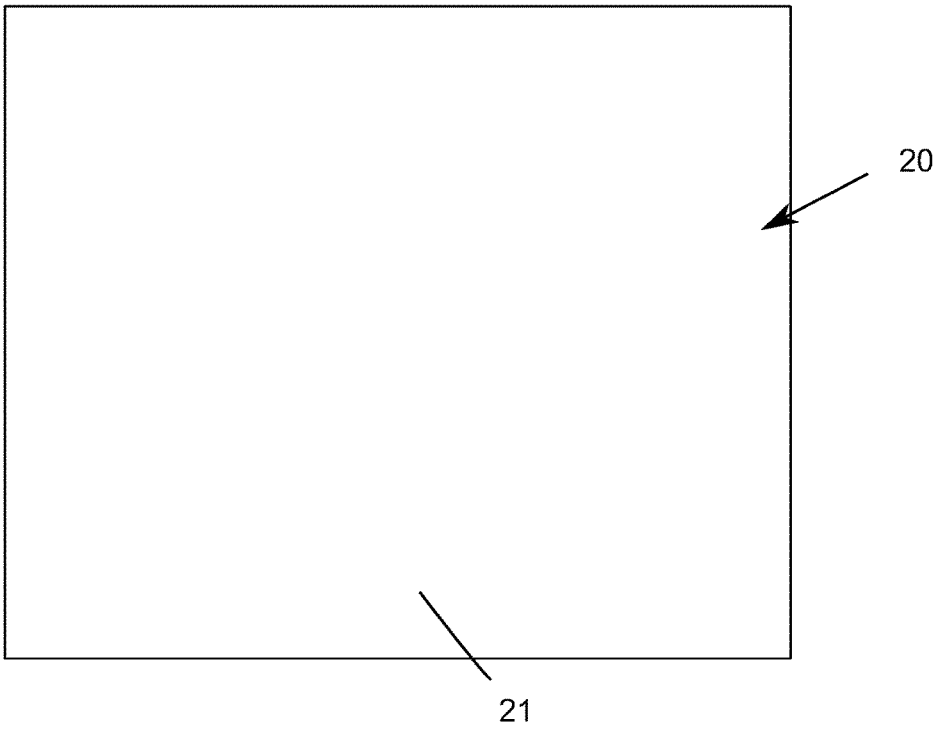
FIG. 11 is a top view of a second embodiment of my footrest
Figure 12:
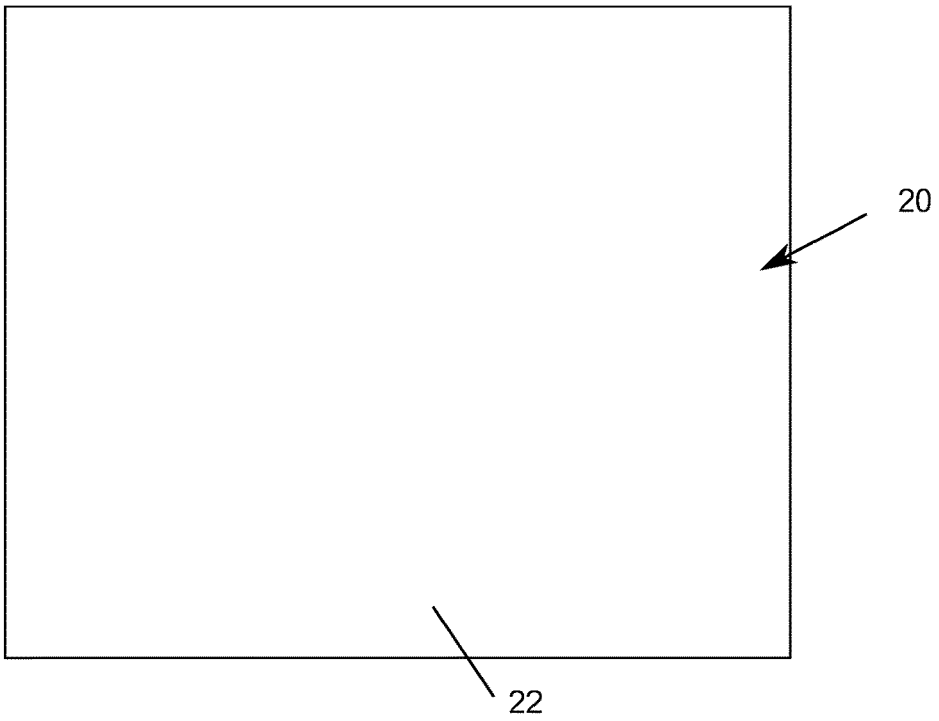
FIG. 12 is a bottom view of a second embodiment of my footrest.

FIG. 13 is a perspective view of the central member of my footrest. In both embodiments, the central member 13 or 23 acts as a bridge to connect the top section with the bottom section of the footrest. As noted above, it has a number of slots to receive the tab on the front and rear pieces. Note that the connection points between the central member 13 or 23 is hingably attached to the top and the bottom at their respective attachment points e. g., 13*b* and 13*c* and 23*b* and 23*c* respectively. This allows the device easily to be folded and unfolded. In the case of the second embodiment, these hinges are shown as 23*b* and 23*c* as shown in FIG. 9, for example.

Optional magnets snaps, clips or hook and loop type fastener dots 14, 15 and 16 (see FIGS. 1, 3, and 13) can be added to secure the footrest when folded.

Figure 14:
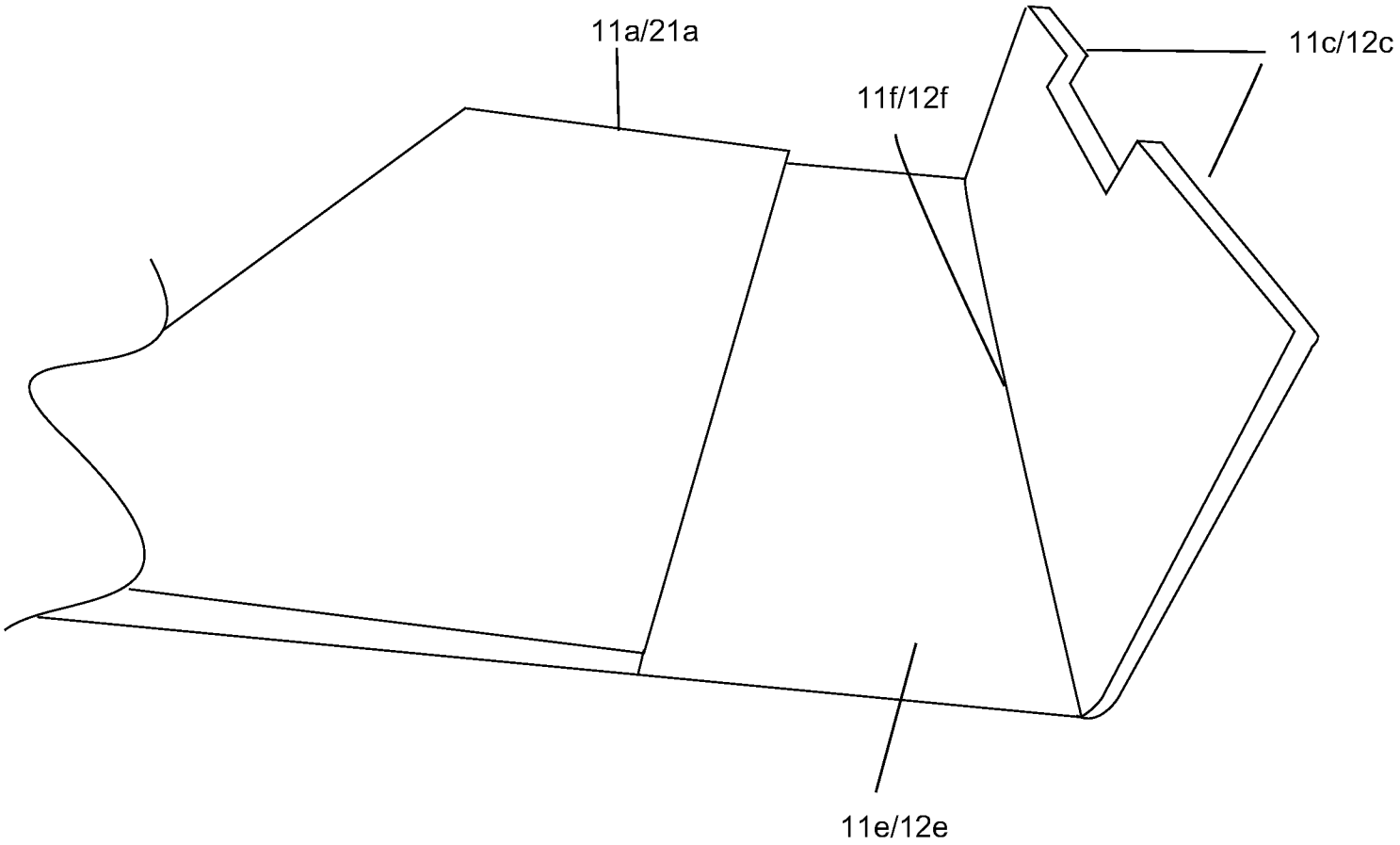
FIG. 14 is a detail showing a recess cut into the top and bottom panels for receiving the front and back flaps when the footrest is folded.
Figure 15:
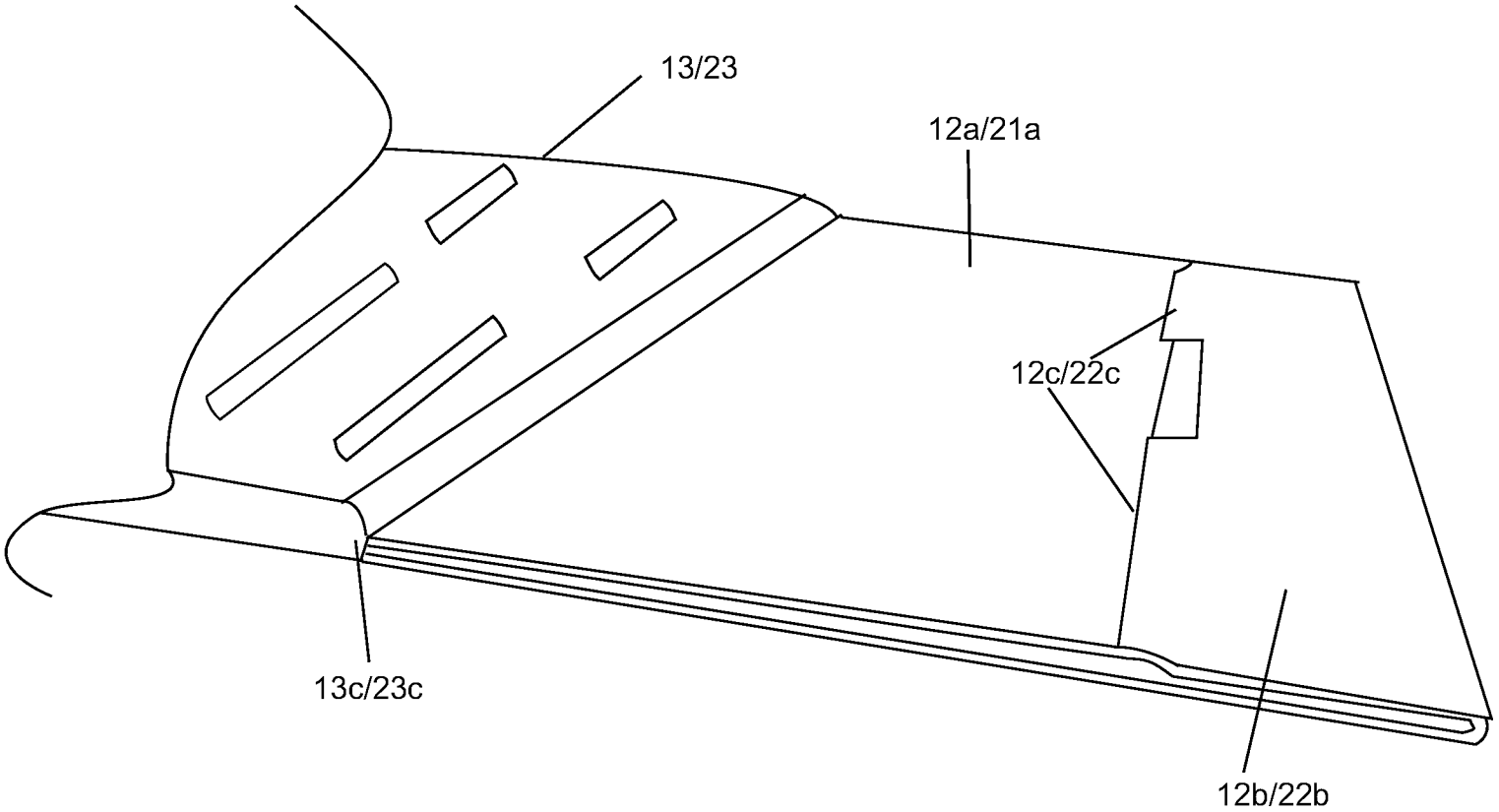
FIG. 15 is a detail showing the flap folded into the recess for storage.

FIG. 14 is a detail showing a recess 11*e* or 21*e* cut into the top panel for receiving the front and back flaps as described below (see also FIG. 15 when the footrest is folded (the bottom 12 is shown here)).

A unique feature of this footrest is its ability to fold generally flat. To do this, as mentioned above, the insides of the top and bottom have recess 11*e* or 21*e* and 12*e* or 22*e*, that are formed to receive the front and back pieces. Thus, as shown in FIG. 15, a back piece, either 12*b* or 22*b* is folded into the recess, either 12*e* or 22*e* (see FIG. 14 to see the recess), flat, for storage. The same applies to the front piece in both embodiments. Note that the connection between the top 11*a* and the front piece 11*b* forms a hinge 11*f* or 21*f* (FIG. 14) about which the front piece can be folded and unfolded. Similarly, the edge between the bottom 12*a* and the back piece 12*b* forms a hinge 12*f* or 22*f* for those parts to fold.

Figure 16:
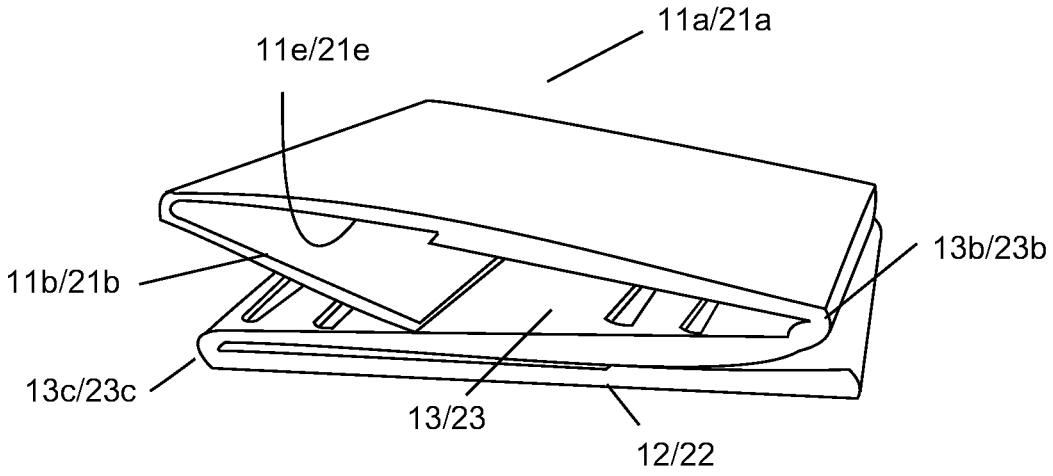
FIG. 16 shows the footrest partially folded for storage.
Figure 17:
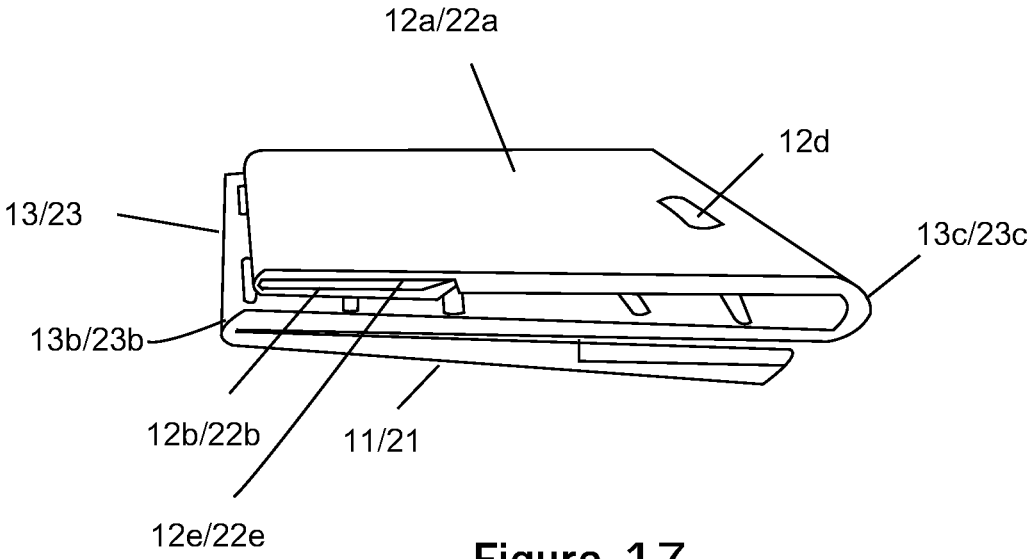
FIG. 17 shows the footrest folded for storage.

FIG. 16 shows the footrest partially folded for storage. In this view the bottom has been folded and the front piece is shown being folded into the top. FIG. 17 shows the footrest folded for storage. In this view, the folded footrest is shown with a fairly flat profile, that makes it easy to store and carry for use.

To fold the footrest for storage, first the front piece 11*b* in the first embodiment, is raised from the center portion 13 and is folded up into the recess 11*e* on the underside of the top 11*a*. The back piece 12*b* is raised from the center section and folded into the recess 12*e* against the inside of the bottom 12*a*. See, FIGS. 14 and 15. Then the top section 11 is folded against the top of the center section 13 and the bottom section 12 is folded against the center section 13. At this point, the footrest is folded, as shown in FIG. 17. In this way, the footrest can be carried to wherever it is needed. The footrest can then be quickly opened and the front and back portions can be secured in the central member. The device is then ready for use. Note, the different slots in the central member can be used to adjust the height of the footrest within limits. Again, the same steps apply to the second embodiment.

Figure 18:
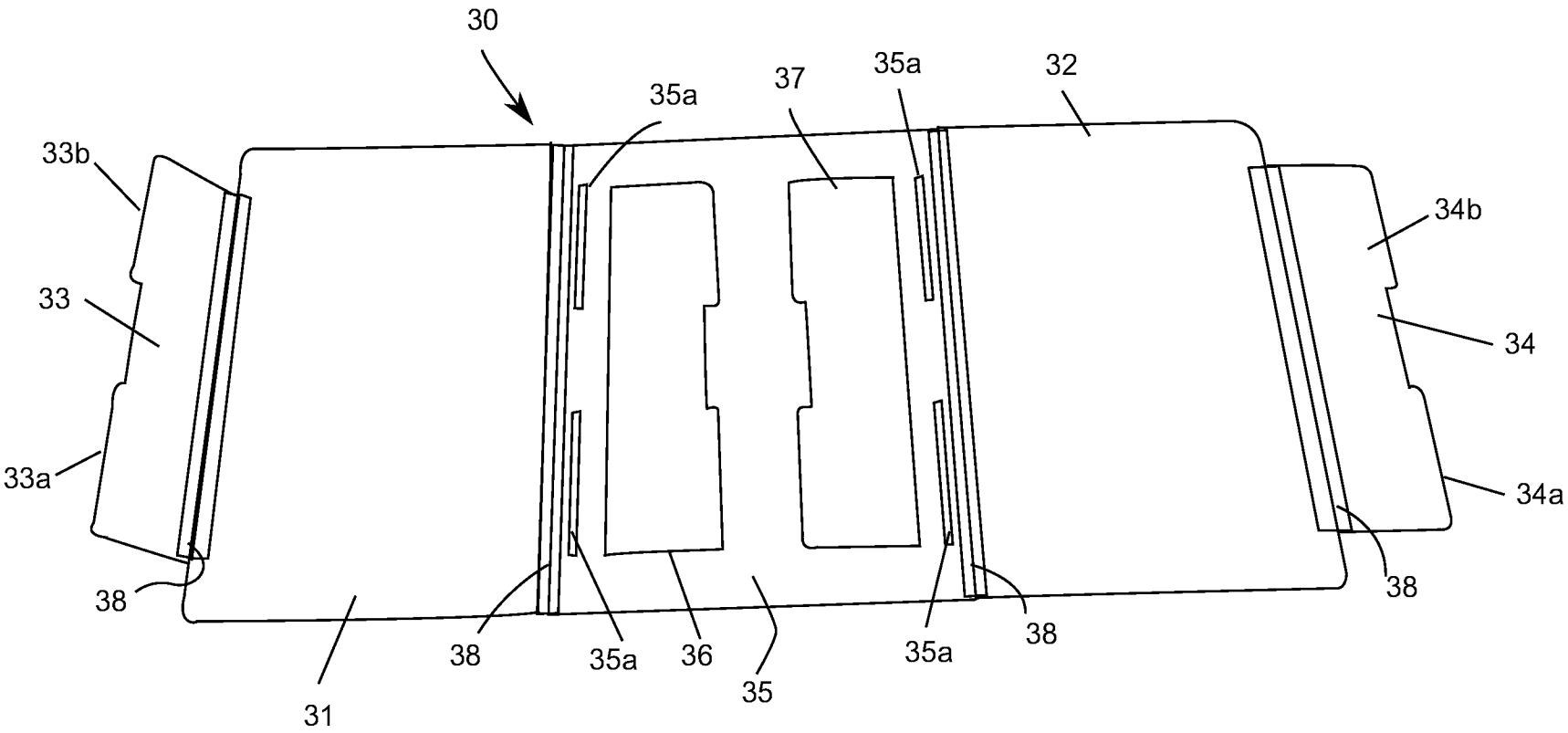
FIG. 18 is a perspective view of the preferred embodiment shown opened for assembly.

FIGS. 18-25 show the preferred embodiment of the invention 30. In the preferred embodiment, the central member 35 has a pair of notches 35*a* on each end as shown, to receive the front and back pieces 33 and 34. Unlike the center portion of the previous embodiments, which have a set of notches that allows the height of the foot rest to be adjusted, this central member has two openings 36 and 37 that are shaped to accept the front and back ends of the footrest, as discussed below. In this way, the foot rest can be folded flatter than the previous embodiments. FIG. 18 is a perspective view of the preferred embodiment shown opened for assembly. This view shows the device 30 in its open configuration. As noted above, this embodiment has a central member 35 has a pair of slots 35*a* on each end as shown, to receive the front and back pieces 33 and 34. Unlike the center portion of the previous embodiments, which have a set of slots that allows the height of the foot rest to be adjusted, this center portion has two openings 36 and 37 that are shaped to accept the front and back ends of the footrest. As before a top 31 and a bottom 32 are attached to the central member 35. Both the front and back pieces 33 and 34 as well as the top and bottom 31 and 32 are attached by living hinges 38, which are represented as shown, although the hinges are integral to the pieces—i. e., the front piece 33 is hinged to the top 31 by a thin member formed between them. In this way, the front and back pieces 33 and 34 are hinged to the top and bottom 31 and 32 and the top and bottom 31 and 32 are hinged to the central member 35.

Figure 19:
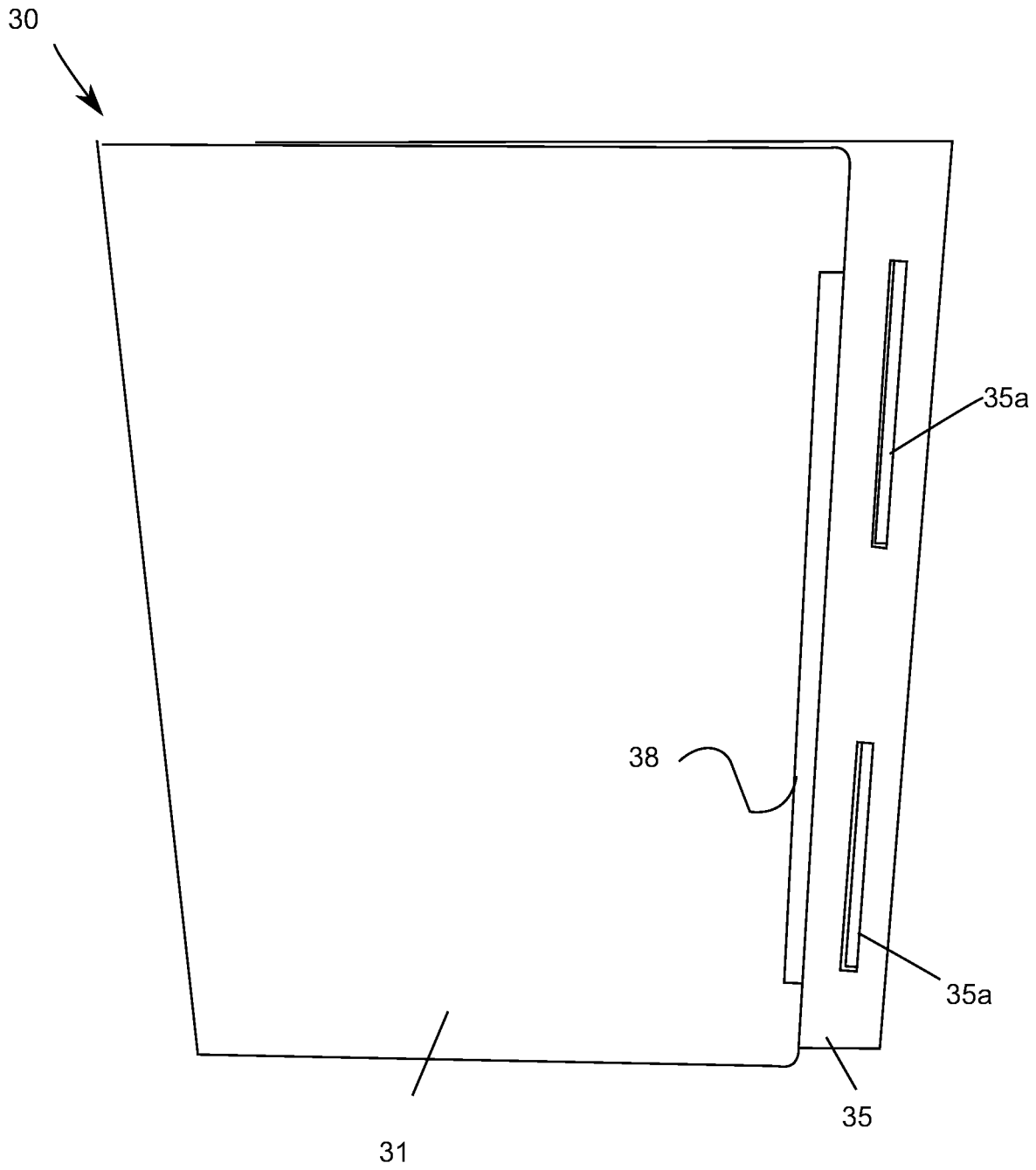
FIG. 19 is a top view of the preferred embodiment shown folded for storage.
Figure 20:
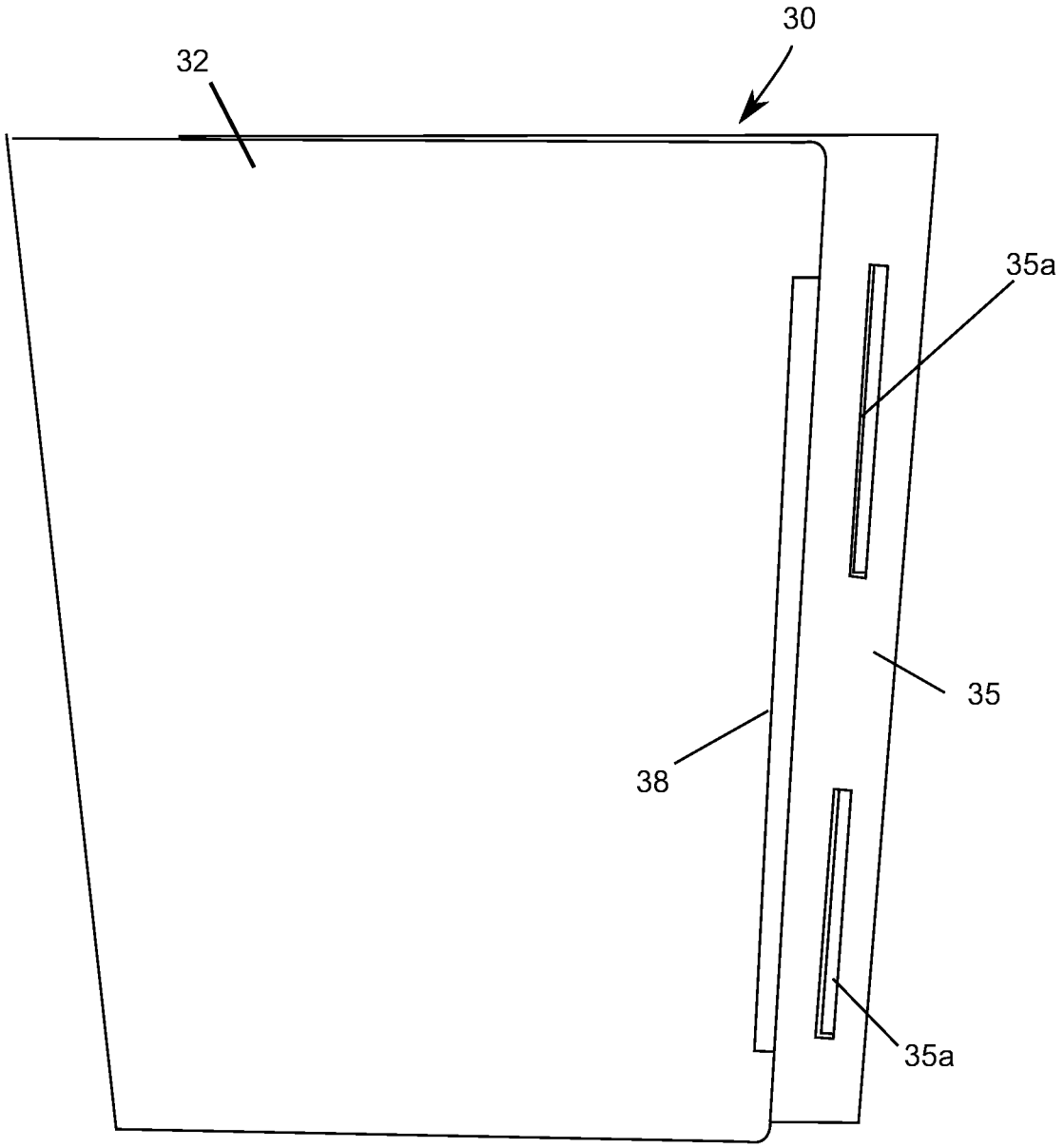
FIG. 20 is a bottom view of the preferred embodiment shown folded for storage.

FIGS. 19 and 20 show top and bottom views, respectively, of the preferred embodiment shown folded for storage.

Figure 21:
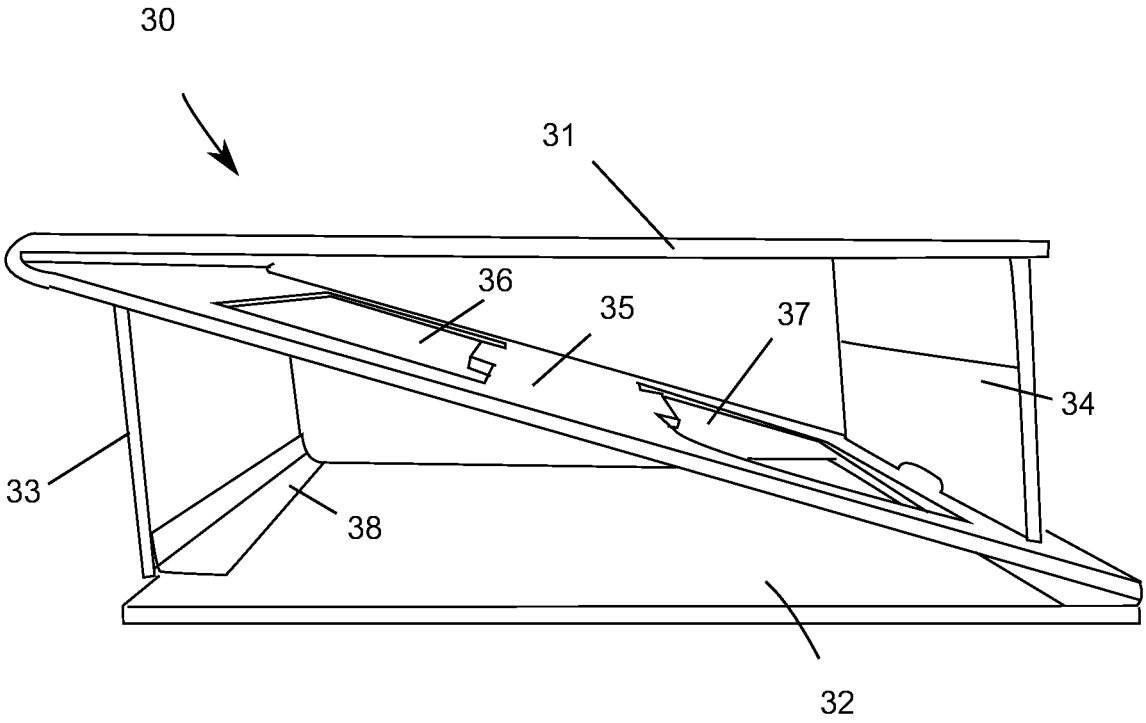
FIG. 21 is a left side view of the preferred embodiment shown assembled.

FIG. 21 is a left side view of the preferred embodiment shown assembled. In this figure, note how the ends fit into the center portion in a similar manner to the other embodiments.

Figure 22:
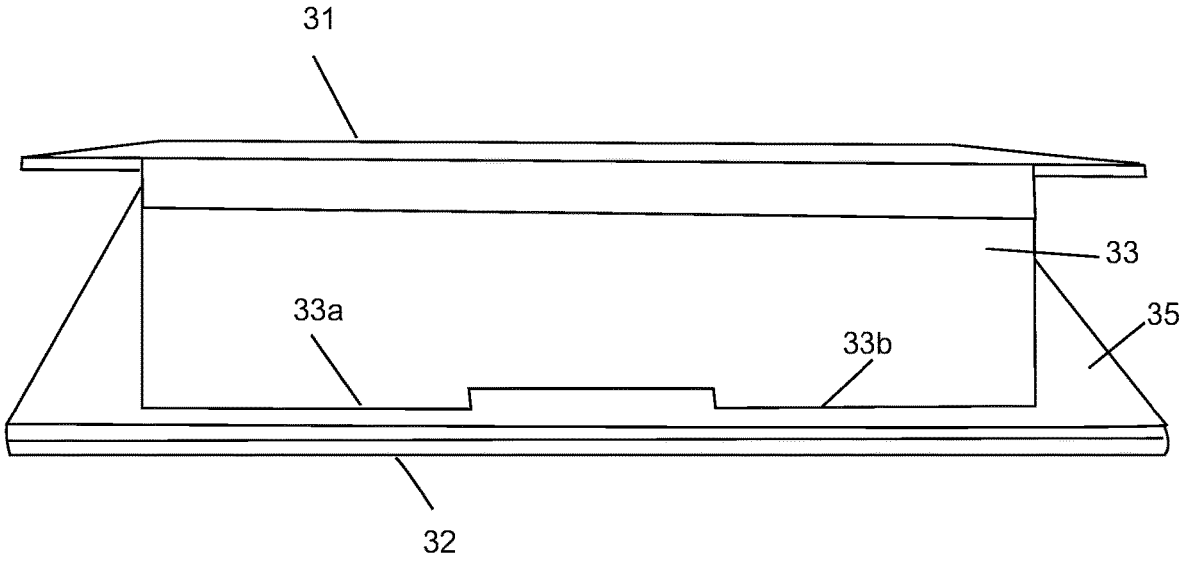
FIG. 22 is a front view of the preferred embodiment shown assembled.

FIG. 22 is a front view of the preferred embodiment shown assembled. In this figure note how the tabs 33*a* and 33*b* fit into the center section 35.

Figure 23:
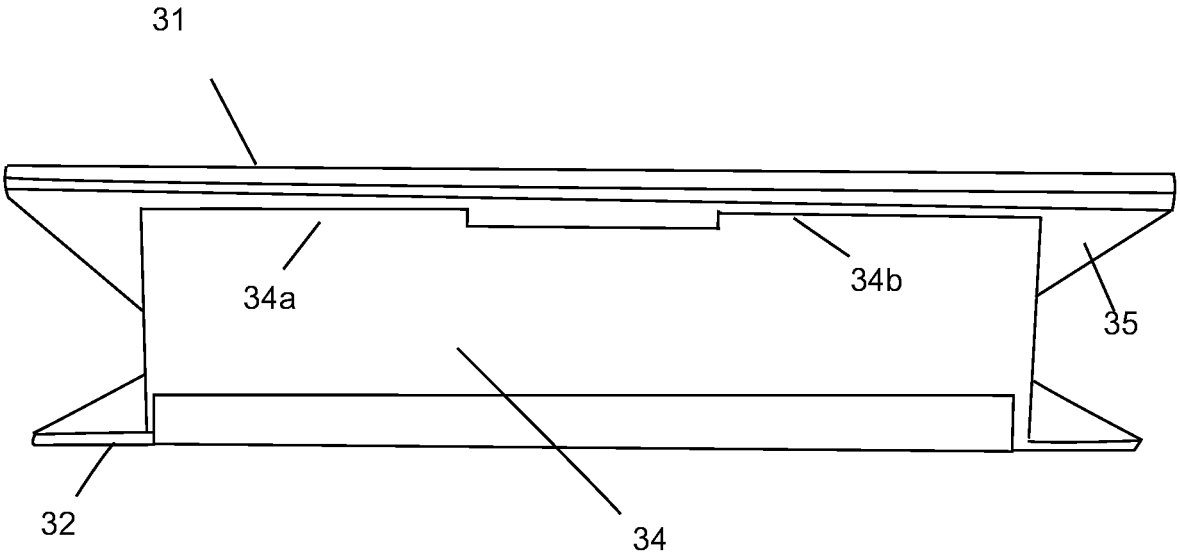
FIG. 23 is a rear view of the preferred embodiment shown assembled.
Figure 24:
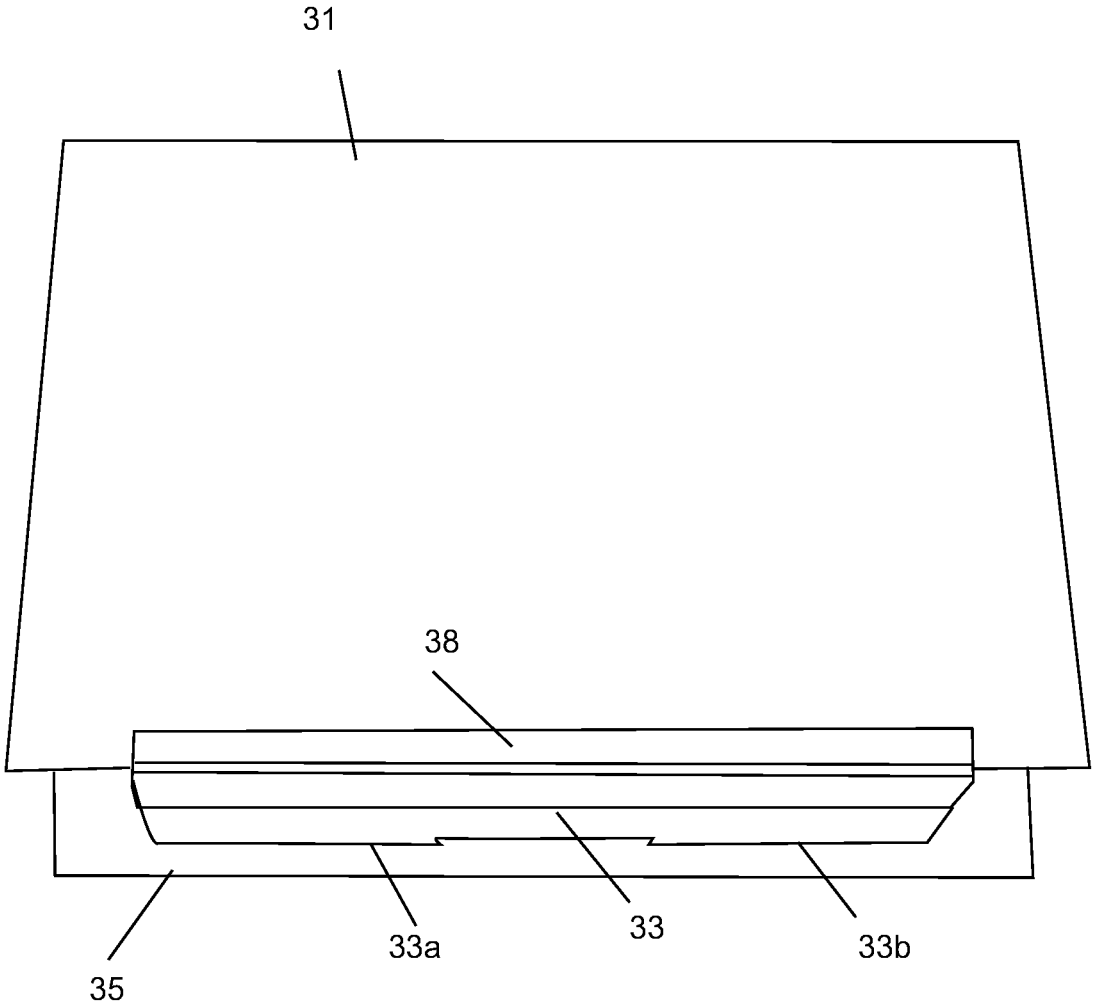
FIG. 24 is a top front perspective view of the preferred embodiment shown assembled.
Figure 25:
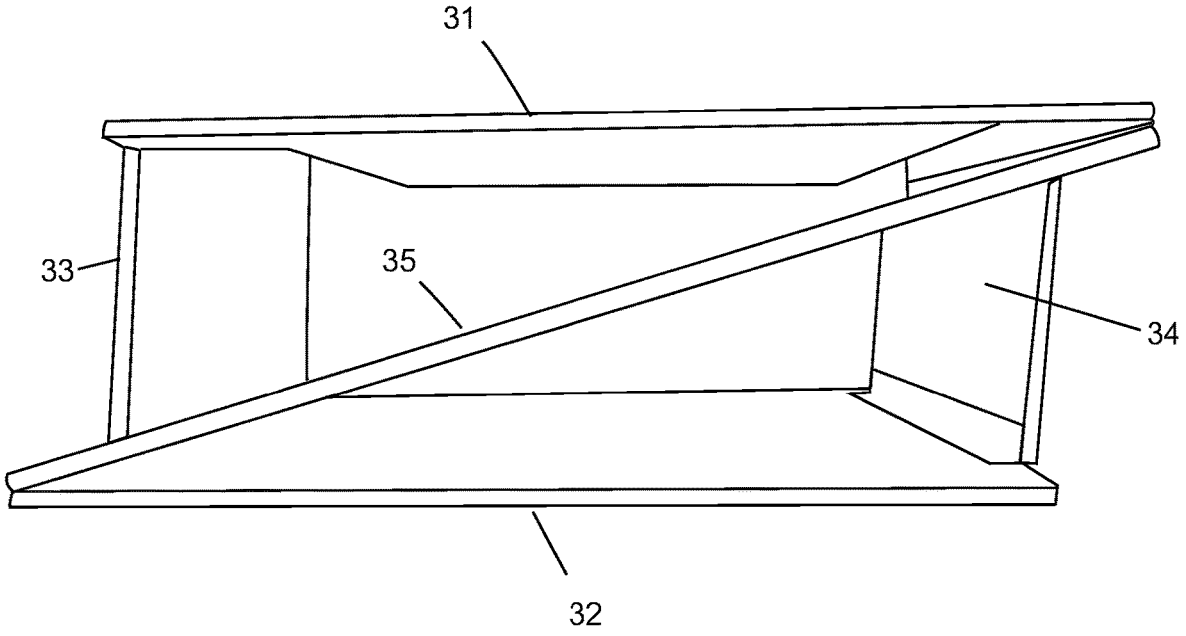
FIG. 25 is a right side view of the preferred embodiment shown assembled.

FIG. 23 is a rear view of the preferred embodiment shown assembled. In this figure note how the tabs 34*a* and 34*b* fit into the central member 35. FIG. 24 is a top front perspective view of the preferred embodiment shown assembled. Finally, FIG. 25 is a right side view of the preferred embodiment shown assembled.

The present disclosure should not be construed in any limited sense other than that limited by the scope of the claims having regard to the teachings herein and the prior art being apparent with the preferred form of the invention disclosed herein and which reveals details of structure of a preferred form necessary for a better understanding of the invention and may be subject to change by skilled persons within the scope of the invention without departing from the concept thereof.

I claim:

1. A folding footrest comprising:

a) a top section having a top, a front, and a back oppositely disposed from said front, said top section also having a front piece on the front of said top section, said front piece also having at least one tab formed thereon;

b) a bottom section having a bottom, a front, and a back oppositely disposed from said front, said bottom section also having a back piece on the back of said bottom section, said back piece also having at least one tab formed thereon;

c) a central member having a top end and a top surface, and a bottom end and a bottom surface, said central member also having at least one pair of slots formed therein;

d) wherein the back of said top section is hingably attached to said top end of said central member such that said top section is aligned over said top surface of said central member; and e) further wherein the front of said bottom section is hingably attached to said bottom end of said central member such that said bottom section is aligned over said bottom surface of said central member.

2. The folding footrest of claim 1 wherein said folding footrest has a first position wherein said folding footrest is folded, and a second position wherein said footrest is open.

3. The folding footrest of claim 2 wherein a) when said folding footrest is in said second position said at least one tab on said front piece is inserted in one of said at least one pair of slots formed in said central member; and b) said at least one tab on said back piece is inserted in the other of said at least one pair of slots formed in said central member.

4. The folding footrest of claim 1 wherein said front piece is hingably attached to said top at a formed hinge; and wherein said back piece is hingably attached to said bottom at a formed hinge.

5. The folding footrest of claim 4 wherein said top has a recessed portion formed abutting said formed hinge, said recessed portion being sized to receive said front piece.

6. The folding footrest of claim 4 wherein said bottom has a recessed portion formed abutting said formed hinge, said recessed portion being sized to receive said back piece.

7. The folding footrest of claim 1 further comprising fasteners attached to the front piece, the back piece and the center piece for securing the footrest when folded.

8. The folding footrest of claim 7 wherein the fasteners are selected from the group of magnets snaps clips and hook and loop type fastener dots.

9. The folding footrest of claim 1 wherein the center portion further comprises a pair of openings formed in said central member and further wherein one of said pair of openings conforms to the shape of the front piece and the second of said pair of openings conforms to the shape of the back piece such that said front and back pieces are placed in said pair of openings for storage.

10. A method of folding a folding footrest for storage, having a top section having a top and a front piece, said front piece also having at least one tab formed thereon, a bottom section having a bottom and a back piece, said back piece also having at least one tab formed thereon; a central member having a top end and a top surface, and a bottom end and a bottom surface, said central member also having at least one pair of slots formed therein; said central member also having a pair of openings formed in said central member and further wherein one of said pair of openings conforms to the shape of the front piece and the second of said pair of openings conforms to the shape of the back piece; wherein the top section is hingably attached to said top end of said central member such that said top section is aligned over said top surface of said central member; and further wherein the bottom section is hingably attached to said bottom end of said central member such that said bottom section is aligned over said bottom surface of said central member; comprising the steps of:

a) raising the front piece from the central member;

b) folding said front piece into said opening in said central member to receive said front piece;

c) lowering the back piece from the central member;

d) folding said back piece into said opening in said central member to receive said back piece;

e) folding the top section against the top of the central member; and f) folding the bottom section against the bottom of the central member.

11. The method of claim 10 wherein said footrest further comprises fasteners, attached to the front piece, the back piece and the center piece for securing the footrest when folded.

12. The method of claim 11 further comprising the steps of:

a) after step f, securing the top section to said center section with a fastener; and b) securing the bottom section to said center section with a fastener.

* * * * *